US005441113A

United States Patent [19]

Pierce

[11] Patent Number: 5,441,113

[45] Date of Patent: Aug. 15, 1995

[54] FIRE EXTINGUISHING SYSTEM

[76] Inventor: Lauvon Pierce, Rte. 1 Box 122, Leakesville, Miss. 39451

[21] Appl. No.: 208,463

[22] Filed: Mar. 9, 1994

[51] Int. Cl.[6] ..... A62C 35/00

[52] U.S. Cl. ..... 169/5; 169/15

[58] Field of Search ..... 169/5, 14, 15, 37, 90; 239/398, 407, 414

[56] References Cited

U.S. PATENT DOCUMENTS

| | | | |
|---|---|---|---|
| Re. 29,155 | 3/1977 | Mears et al. . | |
| 2,857,971 | 10/1958 | Ferris . | |
| 3,356,148 | 12/1967 | Jamison . | |
| 3,592,269 | 7/1971 | Stults . | |
| 3,709,302 | 1/1973 | Stults . | |
| 3,750,754 | 8/1973 | Stults . | |
| 3,820,607 | 6/1974 | Miley . | |
| 3,917,117 | 11/1975 | Plotsky . | |
| 3,934,604 | 1/1976 | Sanderson et al. | 169/14 |
| 3,977,474 | 8/1976 | Boegli | 169/14 |
| 4,047,571 | 10/1977 | Chaintrier . | |
| 4,773,485 | 9/1988 | Silverman . | |
| 4,821,963 | 4/1989 | Arnout et al. . | |
| 4,836,409 | 6/1989 | Lane . | |
| 5,040,610 | 6/1991 | Blanchong . | |
| 5,085,278 | 4/1992 | Keltner . | |
| 5,096,124 | 3/1992 | Young . | |
| 5,113,945 | 5/1992 | Cable | 169/15 |
| 5,127,479 | 7/1992 | Stehling et al. . | |
| 5,145,014 | 9/1992 | Eberhardt | 169/15 |
| 5,163,203 | 11/1992 | Tanasescu et al. . | |

FOREIGN PATENT DOCUMENTS

| | | |
|---|---|---|
| 373961 | 12/1963 | Switzerland . |
| 2246294A | 1/1992 | United Kingdom . |

*Primary Examiner*—Stephen Avila
*Attorney, Agent, or Firm*—Richard C. Litman

[57] ABSTRACT

An automatic foam fire extinguishing system in which the sprinkler opens to discharge foam at one temperature and close to stop the flow of foam at a lower temperature. The system includes sprinkler header and a reservoir for foam and air. In an alternative embodiment, the reservoir is close coupled to sprinkler header to provide a portable self contained unit.

6 Claims, 3 Drawing Sheets

FIRE EXTINGUISHING SYSTEM

BACKGROUND OF THE INVENTION

1. Field of the Invention

The present invention relates to the field of automatic foam fire extinguishing systems for use in homes, commercial buildings, and vehicles.

2. Description of the Prior Art

Fire protection remains a major concern of property owners. Yet, many property owners can not afford adequate fire protection of their property. Automatic fire extinguishing systems have often constituted by networks of nozzles or sprinklers attached to the ceiling of a room and intended to spray water on a fire. However, water systems have the disadvantage of requiring a relatively large amount of water and causing considerable water damage. To avoid the disadvantages associated with water systems, it has been suggested to fight fires with foams. A relatively smaller volume of foam is needed to fight a fire and foams do not damage the premises.

Automatic foam fire extinguishing systems presently known have generally been designed for use in commercial buildings. These systems generally require an elaborate configuration of foam generating screens and fans and consequently require expensive and time consuming construction. The few systems designed for home use typically provide fire protection for only a small area of a room.

The present invention provides a relatively inexpensive foam fire protection system which may be easily installed into an existing structure or incorporated into a structure under construction. In addition the present system may be used to provide protection to an entire room as opposed to a very localized area within a room.

U.S. Reissue Pat. No. 29,155, issued to James W. Mears et al. on Mar. 22, 1977, discloses a On-Off Sprinkler for a fire protection sprinkler system in which the sprinkler opens to discharge water at one temperature and closes to stop flow at a lower temperature.

U.S. Pat. No. 2,857,971, issued to Edmund A. Ferris on Oct. 28, 1958, discloses a Fire Extinguisher. The Fire Extinguisher comprises a container which holds a heavy volatile liquid fire extinguishing agent and releases the agent when the container is subjected to a predetermined temperature. The '971 invention, however, provide fire protection only to the area directly under the container.

U.S. Pat. No. 3,356,148, issued to Will B. Jamison on Dec. 5, 1967, discloses a Fire Extinguishing apparatus for extinguishing burning oil within a container wherein carbon dioxide is applied to the surface of the burning oil to extinguish the oil and high expansion foam is then applied to cool the oil to a temperature at which the oil will not reignite.

U.S. Pat. No. 3,592,269, issued to Howard C. Stults on Jul. 13, 1971, and U.S. Pat. No. 3,709,302, issued to Howard C. Stults on Jan. 9, 1973, both disclose a Self-Contained Foam Fire Extinguishing System. The '269 and '302 patents provide an independent source of pressurization to a container holding a mixture of water and foam concentrate for delivery to a foam generator having a plurality of nozzle members and a screen to produce high-expansion foam upon activation of the system by a fire detector sensor.

U.S. Pat. No. 3,750,754, issued to Howard C. Stults on Aug. 7, 1973, discloses a Foam Fire Extinguishing System to be coupled to an independent sources of water and foam concentrate. The system of the '754 patent includes a single, common pressurized source which urges water and foam concentrate for delivery to a foam generator having a plurality of nozzle members and a stratified screen to produce a high expansion foam.

U.S. Pat. No. 3,820,607, issued to George E. Miley on May 29, 1973, discloses a Heat Activated, Self Discharging Fire Extinguisher adapted to release a flame retardant material upon exposure to a predetermined temperature. Unlike the present invention, the '607 patent requires the use of a complex configuration of springs and levers.

U.S. Pat. No. 3,917,117, issued to Norman Plotsky on Nov. 4, 1975, discloses a Positive Expulsion Fuel Tank with a Bladder Dispenser which includes a metal tank with a bladder module mounted within the tank.

U.S. Pat. No. 4,047,571, issued to Guy Chaintrier et al. on Sep. 13, 1977, discloses an Automatic Fire Extinguishing System acting through aerated foam filling of the room on fire. Unlike the present invention, the system of the '571 patent requires the use of an air conditioning system with a central blower and air feeding ducts having a outlet in each room.

U.S. Pat. No. 4,773,485, issued to Robert R. Silverman on Sep. 27, 1988, and U.S. Pat. No. 5,127,479, issued to Henry J. Stehling et al. on Jul. 7, 1992, both disclose a Fire Extinguishing System for Cookstoves and Ranges. The systems of the '485 and '479 patents include a fire extinguisher mounted above a hood positioned over a cookstove or range. The fire extinguisher is connected to a pair of nozzles within the hood to dispense fire suppressant over the cookstove.

U.S. Pat. No. 4,836,409, issued to Joseph A. Lane on Jun. 6, 1989, discloses a flexible diaphragm located in a tank connected to a liquid system.

U.S. Pat. No. 5,040,610, issued to Raymond Blanchong on Aug. 20, 1991, discloses a Device for Extinguishing or Retarding Fires which comprises a polymeric vessel, a value and cap assembly, a fire extinguishing medium contained in the vessel.

U.S. Pat. No. 5,085,278, issued to Loren L. Keltner on Feb. 4, 1990 discloses a Foam Proportioning Inductor Apparatus which may be mounted atop a supply tank for providing a quantity of fire extinguishing foam concentrate.

UK Patent Application GB 2246294A, filed on Jan. 7, 1991, discloses a self-contained, trolley or skid-mounted fire-extinguishing system which includes a foam tank and a foam generator.

U.S. Pat. No. 4,821,963, issued to Michel Arnout et al. on Apr. 18, 1989, discloses a Steelworks Cutting Nozzle with a Double Heating Ring comprising an oxidizing outer heating ring and a carburizing inner heating ring surrounding a cutting jet.

U.S. Pat. No. 5,096,124, issued to Timothy M. Young on Mar. 17, 1992, discloses a Burner Apparatus comprising a body defined by a plurality of nozzle ports, a discharge nozzle disposed in each nozzle port, and a water ring assembly disposed around the body.

U.S. Pat. No. 5,163,203, issued on Nov. 17, 1992, discloses a Apparatus for Wet Cleaning of Floors comprising a round rotating brush and an annular suction nozzle having radial openings surrounding the brush.

None of the above inventions and patents, taken either singly or in combination, is seen to describe the instant invention as claimed.

SUMMARY OF THE INVENTION

Accordingly, it is a principal object of the invention to provide an automatic foam extinguishing system having on/off activation.

It is another object of the invention to provide an economical automatic foam fire extinguishing system which may be used in the home, a trailer, or in a vehicle.

It is a further object of the invention to provide an automatic foam fire extinguishing system which may be installed in an existing facility or a facility under construction.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

An automatic foam fire extinguishing system according to the present invention is provided which includes a foam/air reservoir, a sprinkler header activated by fire, and piping connecting the sprinkler header to the reservoir. When the sprinkler system is activated, foam and air are released to fight the fire.

The sprinkler header includes a temperature sensing bimetallic disc which, at a predetermined temperature, activates the sprinkler system. The disc automatically deactivates the sprinkler at a predetermined temperature lower than the first predetermined temperature. Unlike other existing system, the bimetallic disc activates and deactivates the system without the need of electrical power, and consequently reduces the need for expensive electrical wiring. The sprinkler header also includes a unique arrangement for dispensing the foam upon activation. The header includes a foam dispensing ring and an air dispensing ring. Foam is discharged from the foam ring and spread by the air from the air ring. This arrangement eliminates the need for the elaborate and complex configuration of foam screens and fans seen in other foam fire extinguishing systems.

A self-contained version of the system includes a sprinkler header closely coupled to a small reservoir. The self-contained unit can easily be placed in a trailer or even a car to provide an economical means of fire protection.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
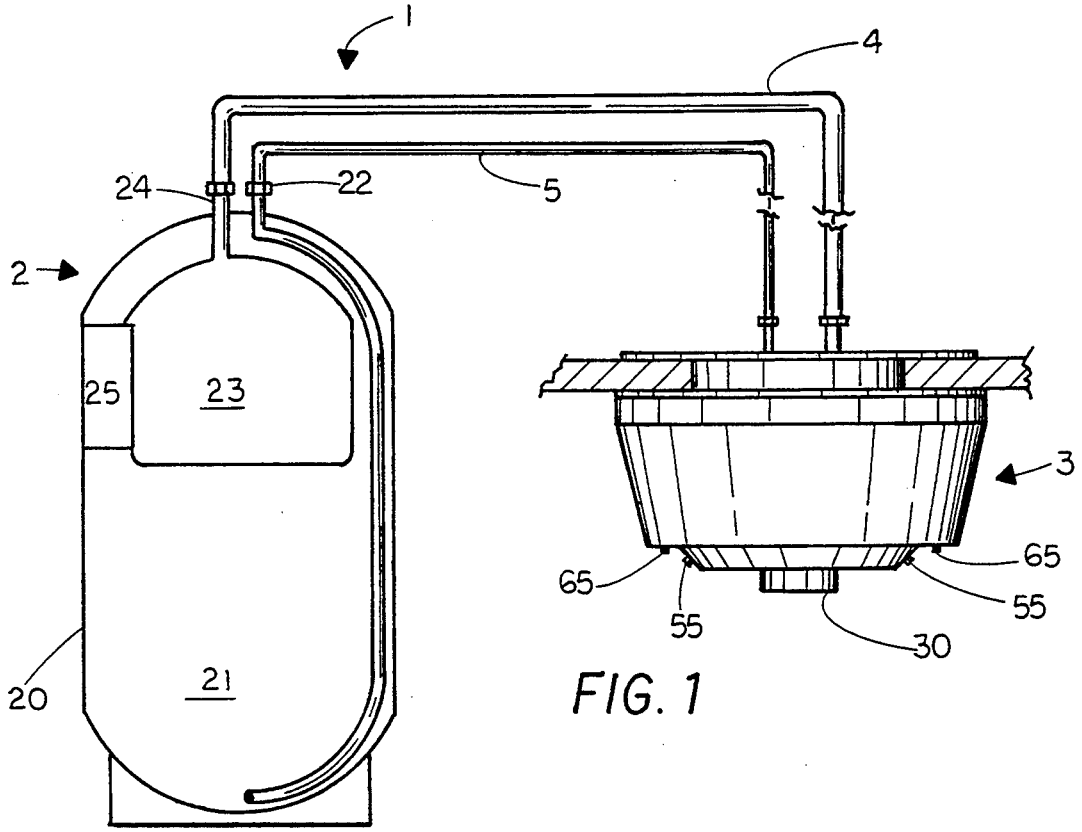
FIG. 1 is a schematic view, in partial cross-section showing the air/foam tank connected to the sprinkler head.
Figure 2:
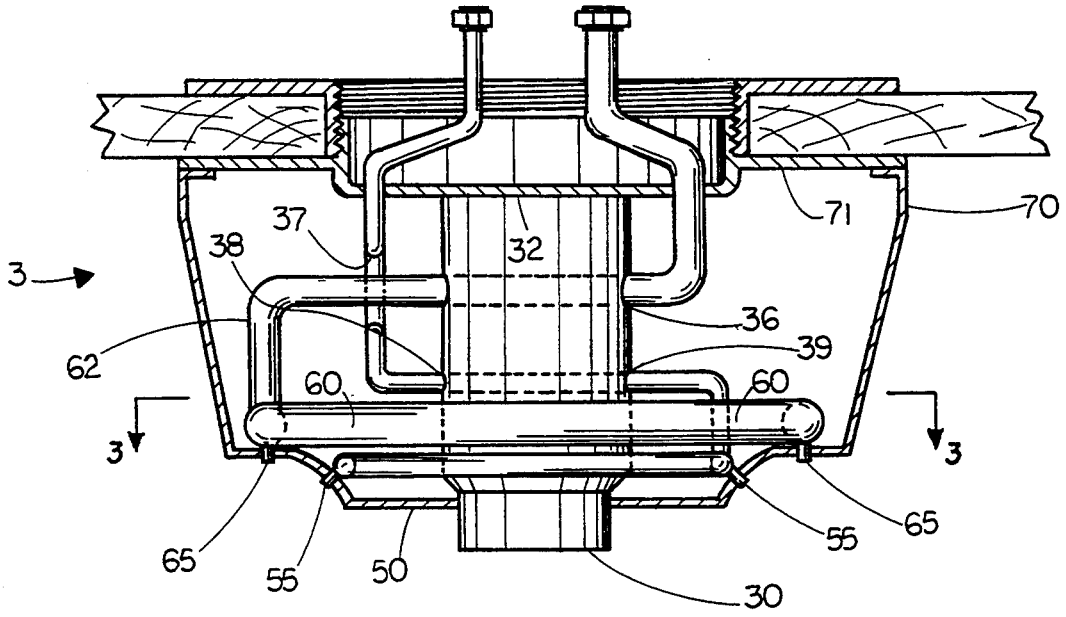
FIG. 2 is a detail view, partly in cross-section, of the sprinkler head within a casing.

The automatic foam fire extinguishing system 1, as shown in FIG. 1 and FIG. 2, includes a vessel 2 for the storage of pressurized foam and air, a sprinkler header 3 for dispensing the foam and air, and piping 4,5 connecting the sprinkler header 3 to the vessel 2.

The vessel 2 includes a shell 20 defining a foam compartment 21, and a foam port 22. The foam port 22 is connected to a foam pipe line 5 which supplies foam to the sprinkler header 3. The vessel 2 also includes a bladder 23 connected to a air port 24 which supplies air to the sprinkler header 3 via the air pipeline 4. The bladder 23 is tubular and generally elongated when pressurized as shown in FIG. 1. The bladder 23 is contractible axially to a length greatly less than in its extended length when depressurized. A bracket 24 may be used to secure the bladder 23 within the vessel 2. The foam compartment 21 may be pressured by coupling a foam supply pump (not shown) to a foam pressurization inlet (not shown). The bladder 23 may pressurized by coupling a compressor (not shown) to a bladder pressurization inlet (not shown).

Figure 3:
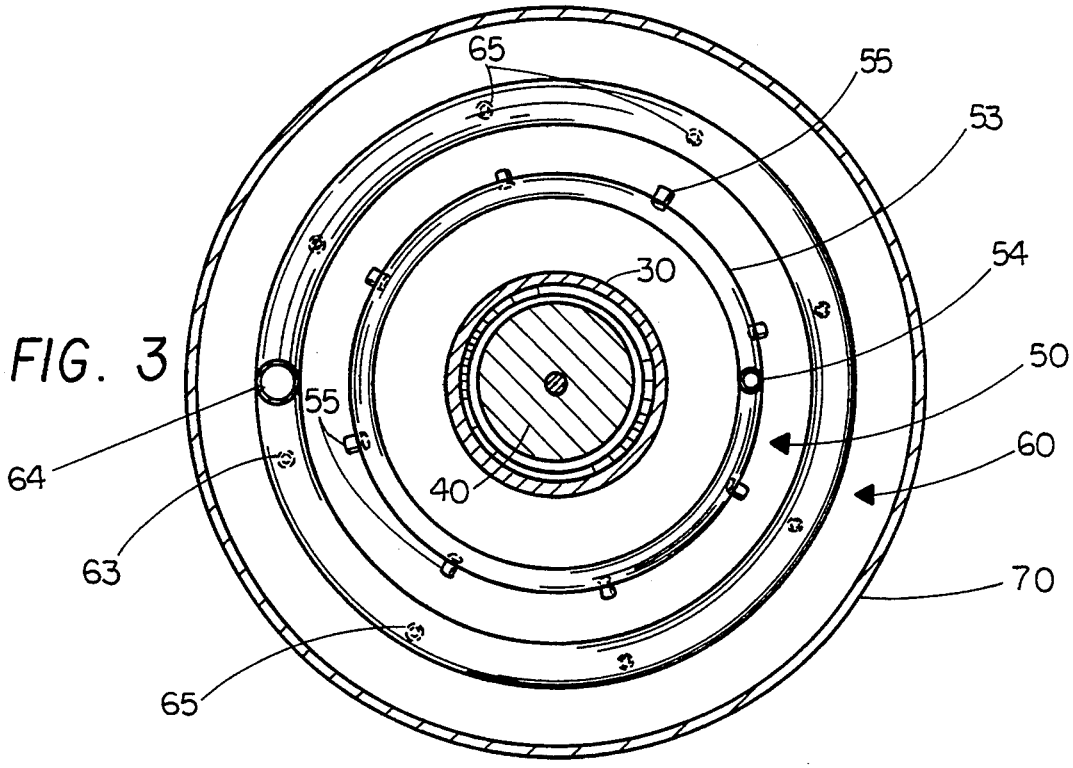
FIG. 3 is a cross section view of the header taken along the lines 3—3 of FIG. 2.
Figure 4:
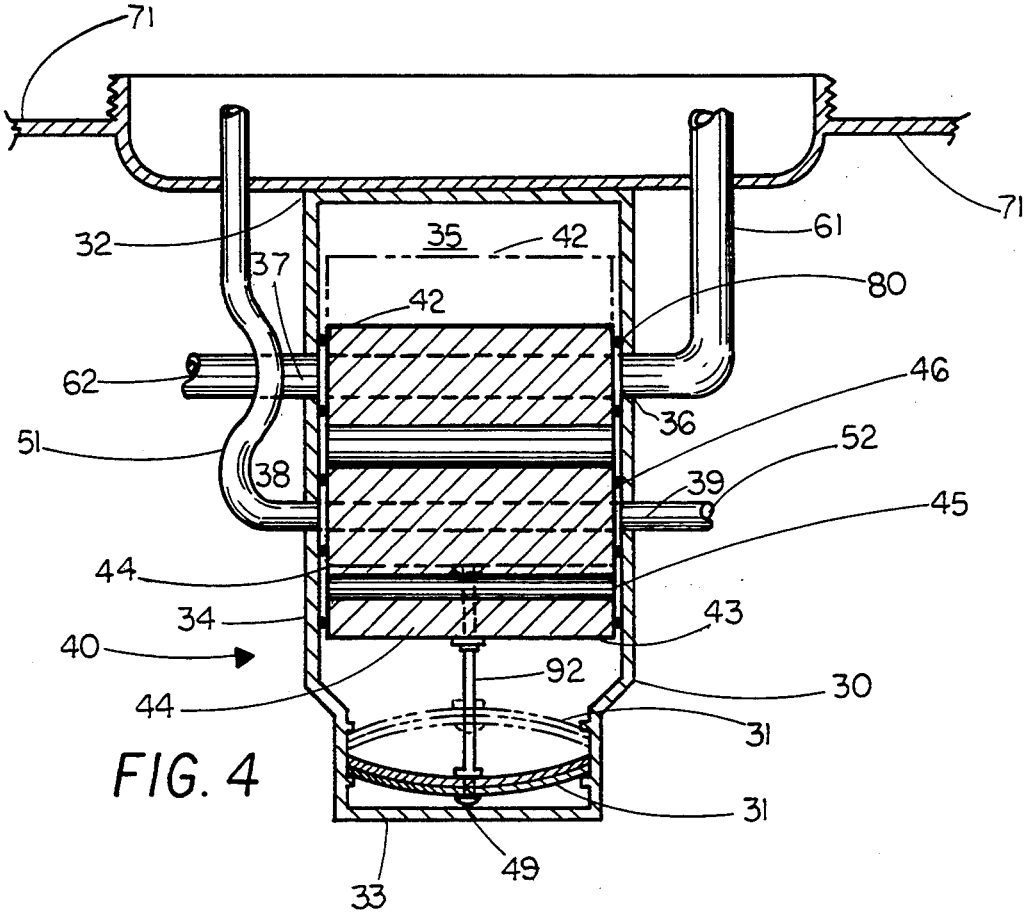
FIG. 4 is a detail view of the sprinkler head core with the casing removed, taken from FIG. 2, partly in cross-section, and drawn to an enlarged scale.

As shown in FIG. 2, FIG. 3, and FIG. 4, the sprinkler header 3 includes a core 30, a piston 40 and bimetallic disc 31 within the core 30, an air dispensing ring 50 (see FIG. 3), a foam dispensing ring 60, a casing 70, and a bracket 71 (see FIG. 4) to support the sprinkler header 3 from the ceiling of a room.

As shown in FIG. 2 and FIG. 4, the piston 40 includes a cylindrical block portion 41 and a rod portion 92 attached to the block 41. The block portion 41 has a top surface 42, a bottom surface 43, and side walls 44. A air bore 45 and a foam bore 46 are drilled through the block 41.

With continued reference to FIG. 4, the cylindrical core 30, has a top surface 32, a bottom surface 33, sidewalls 34 and a cavity 35. An inlet 36 and an outlet 37 for foam are provided in the sidewalls 34 of the core 30. An inlet 38 and outlet 39 for the air supply are also provided in the sidewalls 34 of the core The piston 40 is located within the cavity 35 of the core 30 and may be displaced vertically from a non-activated position to a activated position as denoted by the phantom lines 42'. In the activated position, the foam inlet 36 and foam outlet 37 align with the foam bore 46 to allow foam to flow from the foam supply conduit 61, through the foam bore 46, through the foam dispensing conduit 62, and into the foam dispensing ring 60 (see FIG. 2). Also in the activated position, air inlet 38 and air outlet 39 align with the air bore 45 to allow the flow of air through the air supply conduit 51, through the air bore 45, through the air dispensing conduit 52 and into the air dispensing ring 50. In the non-activated position, O-rings 80, attached to the sidewalls 34 of the core 30, provide sealing engagement between the sidewalls 34 of the core and the side walls 44 of the piston 40 and prevent the flow of both foam and air.

To move the piston 40 from the non-activated position to the activated position, a bimetallic disc 31 is secured to the rod 47 by screw 49. The disc 31 is secured in the core 30 against movement relative to the core, in a manner to move the piston 40 between the activated position and the non-activated position. The disc 31 exhibits a hysteresis effect wherein the disc 31 flexes in one direction as shown by phantom lines 31' to move the piston 40 to the activated position upon the occurrence of a first predetermined temperature, but flexes in the reverse direction to return the piston 40 to the non-activated position upon the occurrence of a second predetermined temperature which is lower than the first predetermined temperature. The operation and attachment of the bimetallic disc may be of the type more fully described in U.S. Pat. No. 3,757,866 issued to James E. Mears et al. on Sep. 11, 1973, reissued as Reissue Pat. No. 29,155, on Mar. 22, 1977. Reissue Pat. No. 29,155 is incorporated herein by reference.

As shown in FIG. 2 and FIG. 3, the foam dispensing ring 60 is generally disposed around the core 30. The foam dispensing ring 60 includes a tubular ring member 63, a foam inlet 64 connected to core 30 by foam dispensing conduit 62, and a plurality of foam dispensing nozzles 65 extending from the foam ring 60. The air dispensing ring 50 is also generally disposed around the core 30 but in a horizontal plane below that of the foam dispensing ring 60. The air ring 50 includes a tubular ring member 53, an air inlet 54 connected to the core 30 by air dispensing conduit 52, and a plurality of air dispensing nozzles 55 extending from the ring member 63. When the system is activated, foam sprays from the foam ring 60, and air discharges from the air ring 50 to help spread the foam.

The sprinkler header 3 may be secured in the ceiling of a room by attaching the bracket 71 to the top surface 32 of the core 30. Once the sprinkler head core 30 has been installed in the ceiling, the casing 70 is secured to the bracket 71. The bottom of the core 30, the air dispensing nozzles 55, and the foam dispensing nozzles 65 all protrude through openings in the casing, as is clearly seen in FIGS. 1 and 2.

Figure 5:
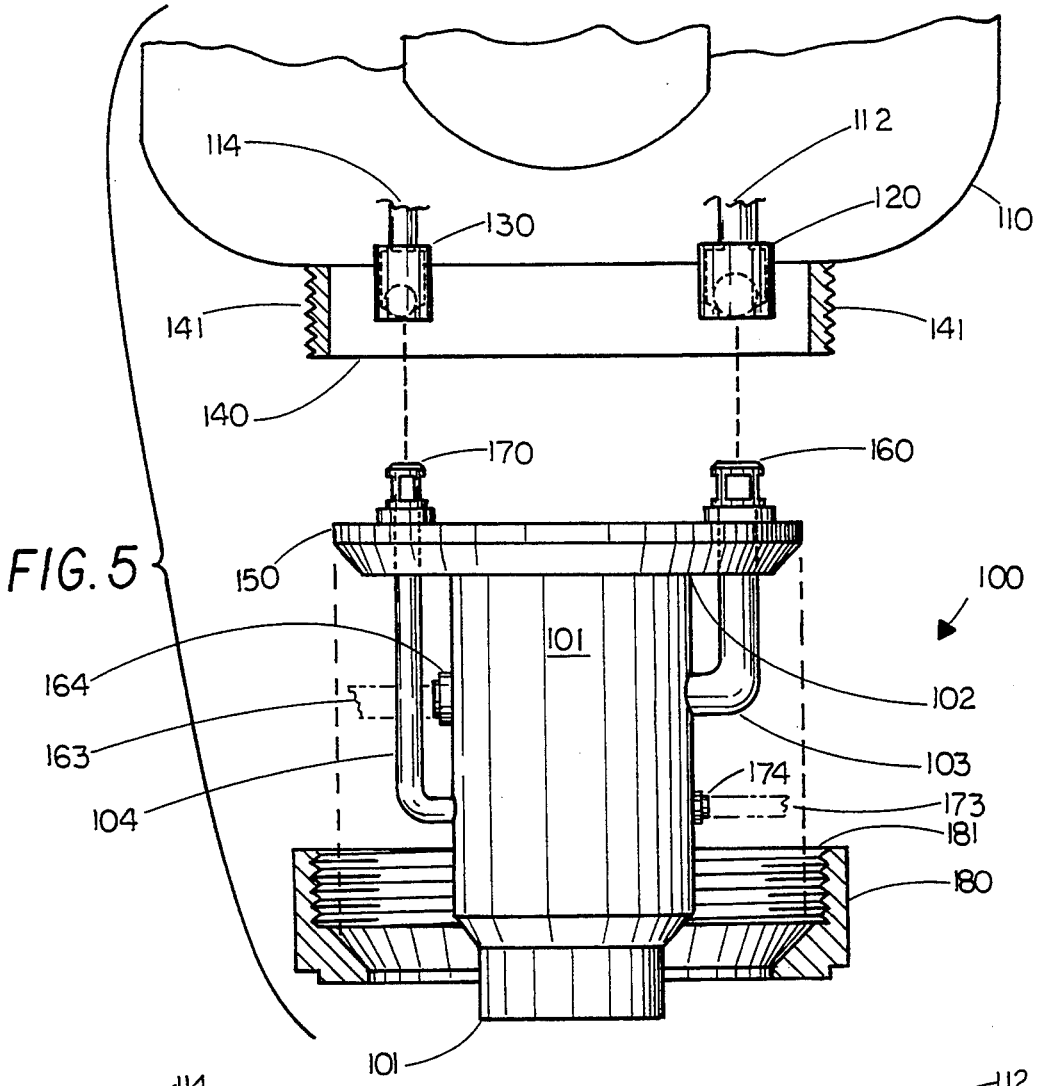
FIG. 5 is an exploded view of a second embodiment.
Figure 7:
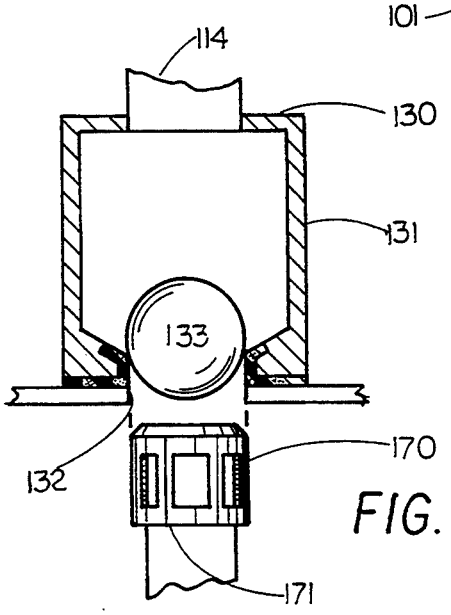
FIG. 7 is a detail view of the air quick connect in the open position for the second embodiment.
Figure 6:
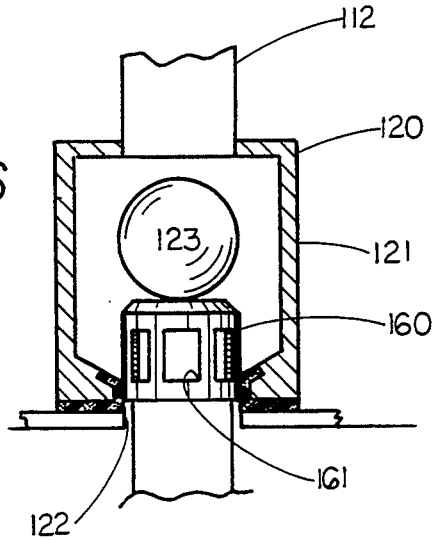
FIG. 6 is a detail view of the foam quick connect in the closed position for the second embodiment.

In an alternative embodiment, as shown in FIG. 5, FIG. 6, and FIG. 7, a sprinkler header 100, constructed as described for the first embodiment, is close coupled to a vessel using quick disconnects to provide a self-contained sprinkler system.

The vessel 110 includes a foam port 112 and an air port 114. Attached to the ports 112, 114 are coupling sleeves 120, 130. Attached to the foam port 112 is a cylindrical foam coupling sleeve 120 having a sleeve portion 121 which terminates in a mouth 122 (see FIG. 6). The mouth portion 122 has a cross-sectional area less than that of the sleeve portion 121. Within the foam coupling sleeve 120 rest a hollow metal ball 123 having a cross-sectional area greater than that of the mouth 122, but less than the cross-sectional area of the foam sleeve portion 121.

Attached to the air port 114 is a cylindrical air coupling sleeve 130 having a sleeve portion 131 which terminates in a mouth 132 (see FIG. 7). The mouth 132 has a cross-sectional area less than that of the sleeve portion 131. Within the air coupling sleeve 130 rest a hollow metal ball 133 having a cross-sectional diameter greater than that of the mouth 132 but less than the cross-sectional area of the sleeve portion 131.

A cylindrical neck 140 with external male threads 141 is welded to the vessel 110. The neck 140 encircles both the air port 114 and the foam port 112, and has a height greater than the coupling sleeves 120, 130.

A beveled plate 150 having a cross-sectional area matching that of the neck 140 is attached to the top surface 102 of the sprinkler header core 101. The foam supply conduit 103 and the air supply conduit 104 extend from the core 101 and through the plate 150 to terminate in vented tubular sections 160 and 170. The vented tubular section 160, which includes a plurality of vents 161 as seen in FIG. 6, is dimensioned for insertion into the mouth portion 122 of the foam coupling sleeve 120. The vented tubular section 170, which includes a plurality of vents 171 as seen in FIG. 7, is dimensioned for insertion into the mouth portion 132 of the air coupling sleeve 130.

A collar 180 with internal female threads 181 is dimensioned to engage the threads 141 of the neck 140. The collar 180 is placed over the core 101 to secure the plate 150 and the attached core 101 to the vessel 110. The self contained unit 100 may be attached to the ceiling of a room using standard brackets.

In operation, the air compartment (not shown) and the foam compartment (not shown) are pressurized through pressurization ports (not shown). The pressure within the air compartment urges the ball 133 against the mouth 132 and restricts air flow through the mouth 132. Similarly, the pressure within the foam compartment urges the ball 123 against the mouth 122 and restricts the flow of through the mouth 122. When the vented tubular sections 160, 170 are inserted into the mouth portions 122, 132, the balls 123, 133 are urged away from the mouths 122, 132 to allow fluid flow. Air flows through the vents 171 of vented tubular section 170 and into the air supply conduit 104 to supply air to the core 101. Foam flows through the vents 161 of vented tubular section 160 and into the foam supply conduit 103 to supply foam to the core 101. The collar 180 is placed over the core 101 and secured to the neck 130.

Once the collar 180 is secured, the foam dispensing conduit 163, which supplies foam to the foam dispensing ring (not shown in FIG. 5), is attached to the foam dispensing connector 164. Additionally, the air dispensing conduit 173, which supplies air to the air dispensing ring (not shown) is attached to the air dispensing connector 174.

It is to be understood that the present invention is not limited to the embodiments described above, but encompasses any and all embodiments within the scope of the following claims.

I claim:

1. A fire extinguishing system of the type employing foam and a gas comprising:

a means for storage of the foam and the gas;

a sprinkler head for dispensing the foam and a gas;

a foam conduit means for providing fluid communication between said vessel and said sprinkler head;

a gas conduit means for providing fluid communication between said vessel and said sprinkler head;

said sprinkler head comprising, a piston, said piston comprising a block portion and a rod portion, said block portion having a top surface, a bottom surface, a vertical side wall connecting said top surface and said bottom surface, means defining a foam bore extending through said side wall, means defining a gas bore extending through said side wall, said rod portion having a first end and a second end, said first end of said rod attached to said bottom surface of said block, a core, said core comprising a core top surface, a core bottom surface, and a vertical core sidewall connecting said core top and said core bottom to define a cavity adapted for accepting said piston, means defining a foam supply aperture in said core sidewall, means defining a foam dispensing aperture within said core sidewall, means defining a gas supply aperture with said core sidewall, and means defining a gas dispensing aperture within said core sidewall, said piston movable vertically within said cavity from a non-activated position to an activated position within said cavity, said foam supply aperture and said foam dispensing aperture of said core in fluid communication with said foam bore of said piston when said piston is in the activated position, and said gas supply aperture and said gas dispensing aperture of said core in fluid communication with said gas bore when said piston is in the activated position, a sealing means for providing sealing engagement between said core sidewall and said side wall of said block;

an activating means within said cavity for moving said piston from the non-activated position to the activated position, an ambient temperature sensor within said cavity of said core for triggering said activating means at a predetermined temperature;

a foam dispensing ring generally disposed around said core, said foam dispensing ring comprising a first tubular ring member, means defining a foam inlet orifice, and a plurality of foam dispensing nozzles extending from said first tubular ring member;

a gas dispensing ring generally disposed around said core and below said foam dispensing ring, said gas dispensing ring comprising a second tubular ring member, means defining a gas inlet orifice, and a plurality of gas dispensing nozzles extending form said second tubular ring member;

means for providing fluid communication between said foam inlet of said foam dispensing ring and said foam dispensing aperture of said core;

means for providing fluid communication between said gas inlet of said gas dispensing ring and said gas dispensing aperture of said core;

means for providing fluid communication between said foam conduit means and said foam supply aperture of said core; and means for providing fluid communication between said gas conduit means and said gas supply aperture of said core.

2. The fire extinguishing system according to claim 1, wherein said ambient temperature sensor and said activating means combined comprise, a bimetallic disc, means for securing said bimetallic disc against movement relative to said core, and means for attaching said disc to said second end of said rod of said piston so as to flex said disc in a manner to move said piston between the activated position and the non-activated position, said bimetallic disc exhibiting a hysteresis effect wherein said disc flexes in one direction to move the piston to the activated position upon the occurrence of a first predetermined temperature but flexes in a reverse direction to return said piston to the non-activated position upon the occurrence of a second temperature lower than the first predetermined temperature.

3. The fire extinguishing system according to claims 1 wherein said vessel comprises, a container including a shell defining a foam compartment having a foam port, said foam discharge port coupled to said foam conduit means, and a bladder compartment for the gas, said bladder being tubular and generally elongated when pressurized and being contractible axially to a length greatly less than in its extended length when depressurized, said bladder being communicable to a gas port of said container, said gas port coupled to said gas conduit means.

4. The fire extinguishing system according to claim 3, wherein said gas conduit means, said foam conduit means, said means for providing fluid communication between said foam conduit means and said foam supply aperture of said core, and said means for providing fluid communication between said gas conduit means and said gas supply aperture of said core combined comprise, a foam tubing member, said foam tubing member comprising a first end and a second end, said first end in fluid communication with said foam supply aperture of said core, said second end terminating in a foam vented tubular section, a gas tubing member, said gas tubing member comprising a first end and a second end, said first end in fluid communication with said gas supply aperture of said core, said second end terminating in a gas vented tubular section, a foam coupling sleeve, said foam sleeve comprising a first end attached in fluid communication with said foam port of said container, a foam sleeve portion, and a second end which terminates to a foam mouth portion, said foam mouth portion adapted to accept said foam vented tubular section, said foam mouth portion having a cross-sectional area less than that of said foam sleeve portion, a foam ball stop, said foam ball stop located within said foam sleeve and having a cross-sectional diameter greater than that of said foam mouth portion but less than the cross-sectional area of said foam sleeve portion, means for securing said foam vented tubular section within said foam coupling sleeve, a gas coupling sleeve, said gas sleeve comprising a first end attached in fluid communication with said gas port of said container, a gas sleeve portion, and a second end which terminates to a gas mouth portion, said gas mouth portion adapted to engagingly accept said gas vented tubular section, said gas mouth portion having a cross-sectional area less than that of said gas sleeve portion, a gas ball stop, said gas ball stop located within said gas coupling sleeve and having a cross-sectional diameter greater than that of said gas mouth portion but less than the cross-sectional area of said gas sleeve portion, and means for securing said gas vented tubular section within said gas coupling sleeve.

5. A fire extinguishing system of the type employing foam and a gas comprising:

a vessel for storage of the foam and the gas, said vessel including, a container comprising a shell defining a foam compartment having a foam port, said foam port coupled to a foam conduit means, and a bladder compartment for the gas, said bladder being tubular and generally elongated when pressurized and being contractible axially to a length greatly less than in its extended length when depressurized, said bladder being communicable to a gas port of said container, said gas port coupled to a gas conduit means, a sprinkler head for dispensing the foam and a gas;

said foam conduit providing fluid communication between said vessel and said sprinkler head;

said gas conduit means for providing fluid communication between said vessel and said sprinkler head;

said sprinkler head comprising, a piston, said piston comprising a block portion and a rod portion, said block portion having a top surface, a bottom surface, a vertical side wall connecting said top surface and said bottom surface, means defining a foam bore extending through said side wall, means defining a gas bore extending through said side wall, said rod portion having a first end and a second end, said first end of said rod attached to said bottom surface of said block, a core, said core comprising a core top surface, a core bottom surface, and a vertical core sidewall connecting said core top and said core bottom to define a cavity adapted for accepting said piston, means defining a foam supply aperture in said core sidewall, means defining a foam dispensing aperture within said core sidewall, means defining a gas supply aperture with said core sidewall, and means defining a gas dispensing aperture within said core sidewall, said piston movable vertically within said cavity from a non-activated position to an activated position within said cavity, said foam supply aperture and said foam dispensing aperture of said core in fluid communication with said foam bore of said piston when said piston is in the activated position, and said gas supply aperture and said gas dispensing aperture of said core in fluid communication with said gas bore when said piston is in the activated position;

a sealing means for providing sealing engagement between said core sidewall and said side wall of said block;

a bimetallic disc, means for securing said bimetallic disc against movement relative to said core, and means for attaching said disc to said second end of said rod of said piston so as to flex said disc in a manner to move said piston between the activated position and the non-activated position, said bimetallic disc exhibiting a hysteresis effect wherein said disc flexes in one direction to move the piston to the activated position upon the occurrence of a first predetermined temperature but flexes in a reverse direction to return said piston to the non-activated position upon the occurrence of a second temperature lower than the first predetermined temperature, a foam dispensing ring generally disposed around said core, said foam dispensing ring comprising a first tubular ring member, means defining a foam inlet orifice, and a plurality of foam dispensing nozzles extending from said first tubular ring member;

a gas dispensing ring generally disposed around said core and below said foam dispensing ring, said gas dispensing ring comprising a second tubular ring member, means defining a gas inlet orifice, and a plurality of gas dispensing nozzles extending form said second tubular ring member;

means for providing fluid communication between said foam inlet of said foam dispensing ring and said foam dispensing aperture of said core;

means for providing fluid communication between said gas inlet of said gas dispensing ring and said gas dispensing aperture of said core;

means for providing fluid communication between said foam conduit means and said foam supply aperture of said core; and means for providing fluid communication between said gas conduit means and said gas supply aperture of said core; and means for attaching said sprinkler head to a structure to be protected.

6. A fire extinguishing system of the type employing foam and a gas comprising:

a vessel for storage of the foam and the gas, said vessel comprises, a container comprising a shell defining a foam compartment in fluid communication with a foam port, a bladder compartment for the gas, said bladder being tubular and generally elongated when pressurized and being contractible axially to a length greatly less than in its extended length when depressurized, said bladder being communicable to a gas port of said container, a foam coupling sleeve, said foam sleeve comprising a first end attached in fluid communication with said foam port of said container, a second end which terminates to a foam mouth portion, a foam sleeve portion joining said first end and said second end, said foam mouth portion having a cross-sectional area less than that of said foam sleeve portion, a foam ball stop, said foam ball stop located within said foam sleeve and having a cross-sectional diameter greater than that of said foam mouth portion but less than the cross-sectional area of said foam sleeve portion, a foam tubing member, said foam tubing member comprising a first end and a second end, said first end terminating in a foam vented tubular section, said vented tubular portion adapted to insert into and engage said foam mouth portion of said foam coupling sleeve, means for securing said foam vented tubular section within said foam coupling sleeve, a gas coupling sleeve, said gas sleeve comprising a first end attached in fluid communication with said gas port of said container, a second end which terminates to a gas mouth portion, a gas sleeve portion joining said first end and said second end, said gas mouth portion having a cross-sectional area less than that of said gas sleeve portion, a gas ball stop, said gas ball stop located within said gas sleeve and having a cross-sectional diameter greater than that of said gas mouth portion of said gas coupling sleeve, but less than the cross-sectional area of said gas sleeve portion of said gas coupling sleeve, a gas tubing member, said gas tubing member comprising a first end and a second end, said first end terminating in a gas vented tubular section, said vented tubular section adapted to insert into and engage said gas mouth portion of said gas coupling sleeve, means for securing said gas vented tubular section within said gas coupling sleeve, a sprinkler head for dispensing the foam and a gas;

said foam conduit providing fluid communication between said vessel and said sprinkler head;

said gas conduit means for providing fluid communication between said vessel and said sprinkler head;

said sprinkler head comprising, a piston, said piston comprising a block portion and a rod portion, said block portion having a top surface, a bottom surface, a vertical side wall connecting said top surface and said bottom surface, means defining a foam bore extending through said side wall, means defining a gas bore extending through said side wall, said rod portion having a first end and a second end, said first end of said rod attached to said bottom surface of said block, a core, said core comprising a core top surface, a core bottom surface, and a vertical core sidewall connecting said core top and said core bottom to define a cavity adapted for accepting said piston, means defining a foam supply aperture in said core sidewall, said foam supply aperture coupled to said second end of said foam tubing member, means defining a foam dispensing aperture within said core sidewall, means defining a gas supply aperture with said core sidewall, said gas supply aperture coupled to said second end of said gas tubing member, and means defining a gas dispensing aperture within said core sidewall, said piston movable vertically within said cavity from a non-activated position to an activated position within said cavity, said foam supply aperture and said foam dispensing aperture of said core in fluid communication with said foam bore of said piston when said piston is in the activated position, and said gas supply aperture and said gas dispensing aperture of said core in fluid communication with said gas bore when said piston is in the activated position;

a sealing means for providing sealing engagement between said core sidewall and said side wall of said block;

a bimetallic disc, means for securing said bimetallic disc against movement relative to said core, and means for attaching said disc to said second end of said rod of said piston so as to flex said disc in a manner to move said piston between the activated position and the non-activated position, said bimetallic disc exhibiting a hysteresis effect wherein said disc flexes in one direction to move the piston to the activated position upon the occurrence of a first predetermined temperature but flexes in a reverse direction to return said piston to the non-activated position upon the occurrence of a second temperature lower than the first predetermined temperature, a foam dispensing ring generally disposed around said core, said foam dispensing ring comprising a first tubular ring member, means defining a foam inlet orifice, and a plurality of foam dispensing nozzles extending from said first tubular ring member;

a gas dispensing ring generally disposed around said core and below said foam dispensing ring, said gas dispensing ring comprising a second tubular ring member, means defining a gas inlet orifice, and a plurality of gas dispensing nozzles extending form said second tubular ring member;

means for providing fluid communication between said foam inlet of said foam dispensing ring and said foam dispensing aperture of said core;

means for providing fluid communication between said gas inlet of said gas dispensing ring and said gas dispensing aperture of said core;

means for providing fluid communication between said foam conduit means and said foam supply aperture of said core; and means for providing fluid communication between said gas conduit means and said gas supply aperture of said core;

means for attaching said sprinkler head to a structure to be protected.

* * * * *